US006260243B1

(12) United States Patent
Fildan et al.

(10) Patent No.: US 6,260,243 B1
(45) Date of Patent: Jul. 17, 2001

(54) REVERSIBLE PRESS BUTTON GARMENT CLOSURE

(75) Inventors: Gerhard Fildan, Vienna; Karl Wanzenböck, Leobersdorf, both of (AT)

(73) Assignee: Fildan Accessories Corporation, Englewood, NJ (US)

( * ) Notice: Subject to any disclaimer, the term of this patent is extended or adjusted under 35 U.S.C. 154(b) by 0 days.

(21) Appl. No.: 09/580,254

(22) Filed: May 26, 2000

Related U.S. Application Data

(63) Continuation-in-part of application No. 09/540,339, filed on Mar. 31, 2000.

(51) Int. Cl.[7] ..... A44B 11/00; A44B 21/00

(52) U.S. Cl. ..... 24/329; 24/114.4; 24/662; 450/58

(58) Field of Search ..... 24/329, 590, 591, 24/580, 614, 615, 662, 682.1, 114.4; 450/58, 78, 82; 2/322, 235, 265, 270

(56) References Cited

U.S. PATENT DOCUMENTS

| | | | | |
|---|---|---|---|---|
| 3,200,464 | * | 8/1965 | Cousins | 24/682.1 X |
| 3,979,801 | * | 9/1976 | Tareau | 24/580 X |
| 4,000,544 | * | 1/1977 | Fildan | 24/590 |
| 4,161,806 | * | 7/1979 | Hennisse et al. | 24/580 |
| 5,377,394 | * | 1/1995 | Fildan | 24/590 X |
| 5,427,562 | * | 6/1995 | Kwang | 450/58 |
| 5,784,765 | * | 7/1998 | Fildan | 24/615 |
| 6,009,604 | * | 1/2000 | Fildan | 24/662 |

* cited by examiner

*Primary Examiner*—Robert J. Sandy
(74) *Attorney, Agent, or Firm*—Herbert Dubno

(57) ABSTRACT

A reversible press button closure for shoulder straps of brassieres or back band connectors has hard attachment pieces secured to the garment and connected by pins and lugs with male and female ring members which are molded from a softer plastic and define the press button assembly. The male and female members match in appearance when they are interconnected so that the connector has the same appearance from both sides.

20 Claims, 9 Drawing Sheets

FIG. 3
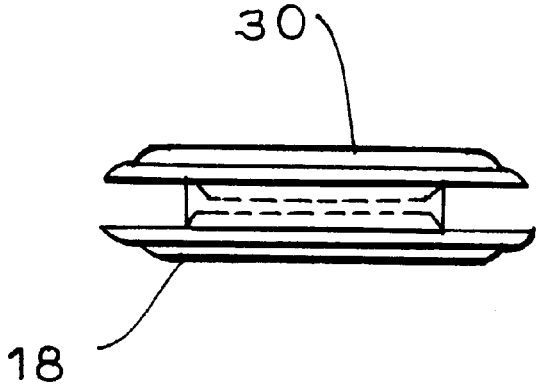
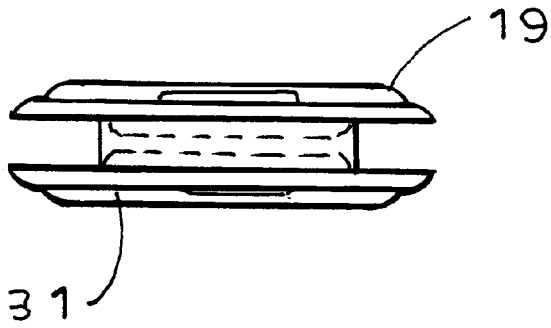
FIG. 4

REVERSIBLE PRESS BUTTON GARMENT CLOSURE

CROSS REFERENCE TO RELATED APPLICATION

This is a continuation-in-part of Ser. No. 09/540,339 filed Mar. 31, 2000.

FIELD OF THE INVENTION

The present invention relates to a reversible press button garment closure which can be used as a garment closure for the back band, for example, of a brassiere or for a shoulder strap of a brassiere or, in general, for interconnecting any two garment parts, especially in cases in which at least one of the parts is a strap or band and most particularly for lingerie, swim suits, brassieres and the like.

BACKGROUND OF THE INVENTION

While there are many closure devices which are used in brassieres, undergarments, lingerie, swim suits and the like to connect two parts of the garment and enable them to be released and reengaged, e.g. the back closure of a brassiere or a shoulder strap thereof, in most instances the closure involves some form of hook and eye engagement. While press button type closures are also known, by and large these are difficult to attach, difficult to use and frequently cannot be reversible, i.e. do not have the same general appearance when seen from opposite sides.

In many garment closure applications, reversibility is an important consideration. Other important considerations for such closures are the ability to take up considerable tensile stress, an ability to be laundered without damage to the fastener or other garments or the garments provide with the fastener itself, ease of manipulation and esthetic appearance.

OBJECTS OF THE INVENTION

It is, therefore, the principal object of the present invention to provide an improved reversible press button fastener, especially for use as the back closure of a brassiere or a shoulder strap closure of a brassiere which will satisfy the requirements outlined above and which nevertheless is free from drawbacks of earlier closures and can, in addition, be used in other garment applications.

Another object of the invention is to provide a garment closure which can be applied to the garment parts to be connected thereby in a versatile and convenient manner, which does little or no damage upon laundering of the garment, has an esthetic appearance, is easily manipulated (opened and closed) and is reversible in the sense it has similar appearances from opposite sides.

SUMMARY OF THE INVENTION

These objects and others which are attained in accordance with the invention in a press button closure which comprises:

- a female closure member in the form of a first ring having a hole and a first lug projecting laterally of the first ring;
- a male closure member in the form of a second ring externally matching the first ring, a boss press-fittingly receivable in the hole, and a second lug projecting laterally of the second ring, the closure members being formed from relatively soft plastic; and
- respective attachment pieces of relatively hard plastic connected to the lugs and securing each of the members to a part of a garment.

According to a feature of the invention, at least one and preferably each of the attachment pieces comprises pair of shield-shaped elements interconnected by posts and straddling the respective part of the garment, i.e. the band or strap parts to which it is secured, and connected to a respective one of the lugs. The attachment of the shield-shaped elements to one another (through the fabric) and, for an appropriate fabric, is by thermal or ultrasonic welding.

Each of the lugs can have a formation mating with a complementary formation in one of the shield-shaped elements and preferably the formations are pins and holes with each lug having in the most preferred arrangement, a row of three holes, through which pins of one shield element pass to be welded in holes of the other shield element.

The fastener can, however, be separable by pulling apart the shield-shaped members and the ring member where a permanent weld is not made.

According to an important feature of the invention, the rings and the shield-shaped members are of different colors and the shield-shaped members can be somewhat translucent to enable at least the outlines of the lug to be visible beneath the shield-shaped element. The ring, lug and pins may be of a different color and since the pins have their ends exposed through the shield-shaped member, the row of pin ends in each shield-shaped member may contribute a design or esthetic feature to the closure. The shield elements and rings may be of different colors on opposite sides when applied to a reversible garment, such as a brassiere having fabrics of different color on opposite sides.

According to a feature of the invention, the shield-shaped elements or welding flanges are formed with projections which, like the pins can pass through the fabric of the strap and can be welded together.

Parts of a back band of the brassiere may be secured to the shield-shaped elements of each attachment piece or the attachment pieces may be mounted on parts of a shoulder strap of a brassiere or like garment.

An important feature of the invention is that the two rings have matching outer parts and, especially outwardly convex curved cross sections which match in appearance. The male member can be a tubular boss which is received in the hole of the other ring and since the edge of that boss is visible from the outer side of the female member, a similar rim can be provided along the inner periphery of the male ring. Both the male and female members may have planar surfaces at which they interengage when the members are interconnected.

An important feature of the invention is that the attachment pieces, i.e. the shield-shaped elements, can be molded from relatively hard and stiff synthetic resin material whereas the rings can be molded from relatively soft and flexible synthetic resin material. The resulting closure is thus highly flexible where it is connected to the garment but rigid where the press button parts, i.e. the two rings, interconnect. The softer material can be polyurethane while the harder material can be polyoxymethylene.

BRIEF DESCRIPTION OF THE DRAWING

The above and other objects, features, and advantages will become more readily apparent from the following description, reference being made to the accompanying drawing in which:

FIG. 3 is a top view of the closure;

FIG. 4 is a bottom view of the closure;

SUMMARY OF THE INVENTION

Figure 1:
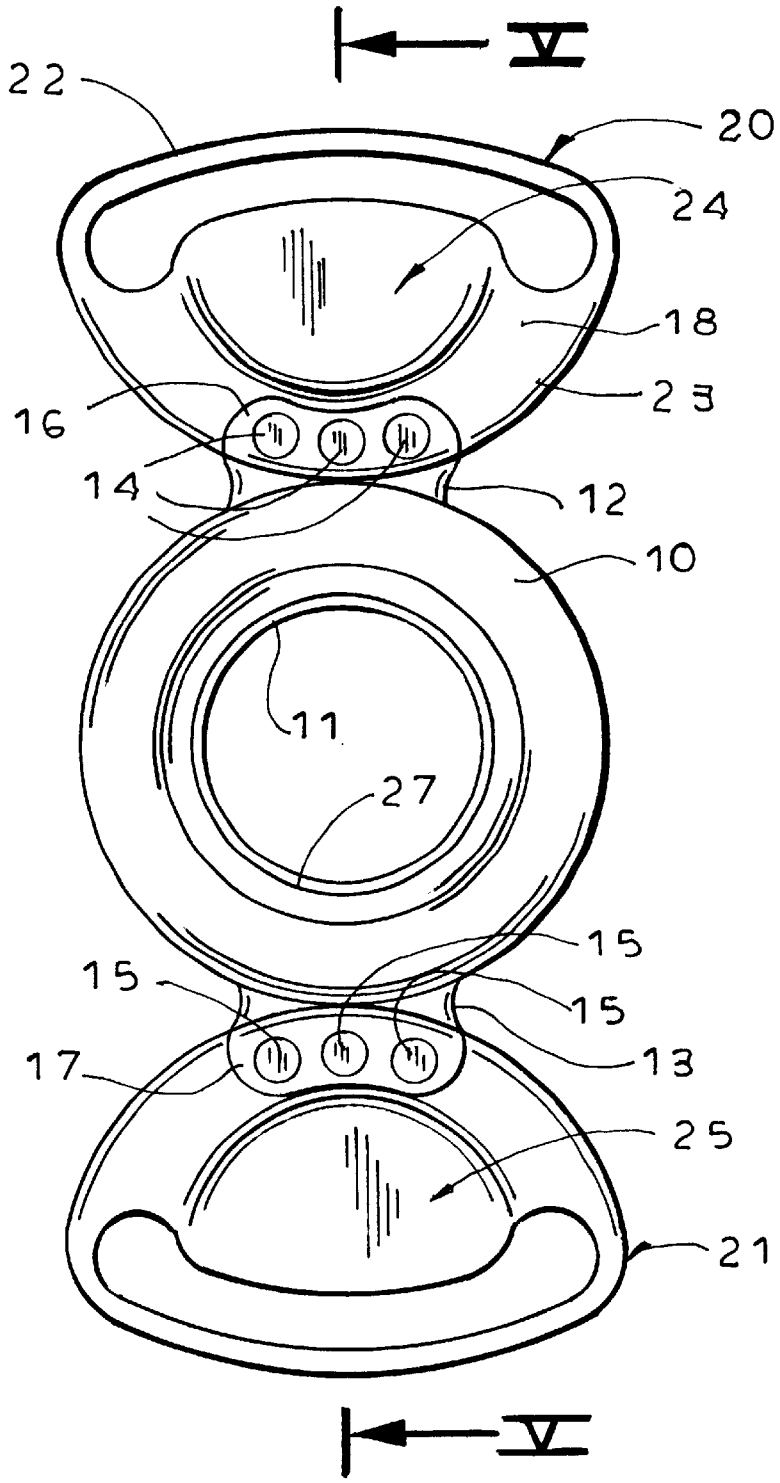
FIG. 1 is a front elevational view of a reversible closure illustrating the present invention.

The basic structure of a reversible push button connector, according to the invention, comprises a female ring member 10 and a male ring member 11, fitted together and provided with respective lugs 12 and 13 which, in the connector illustrated, each have three holes 14 and 15 to be engaged by pins 16 and 17 of a shield-shaped member as will be described. The shield-shaped members 18 and 19 form attachment pieces 20 and 21, respectively, secured to respective parts of the garment.

As can be seen from FIG. 1, the shields 18 and 19 each are composed of a relatively rigid injection molded synthetic resin which is somewhat translucent so that the outline of the respective lug 12, 13 can be seen through it. The shields 18 and 19 are of rather shallow curvature at 22 and have a curvature 23 of a lesser radius or curvature to impart the shield shape. The shields 18 and 19 also bulge outwardly at their center portions 24 and 25 as is visible in FIG. 1.

Figure 2:
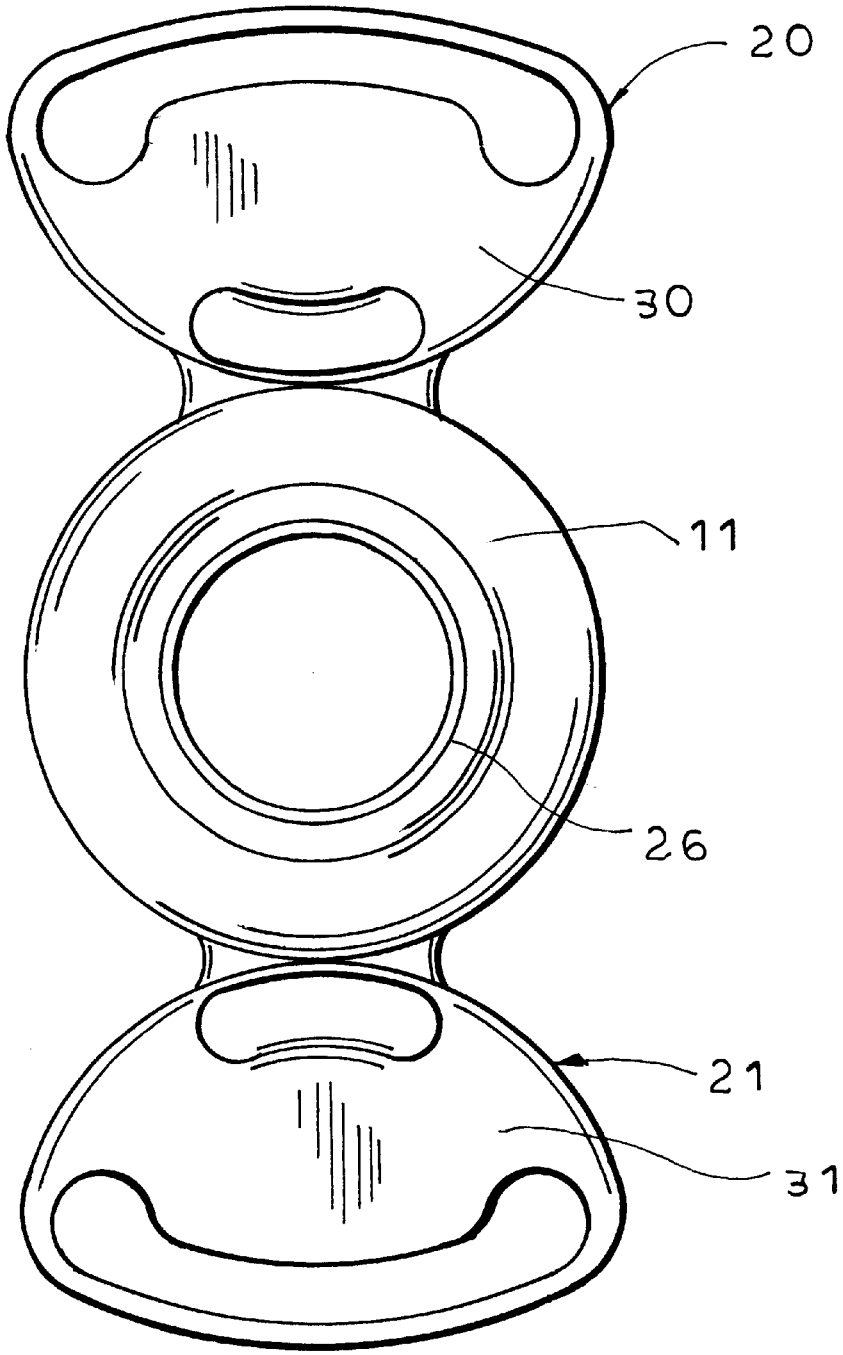
FIG. 2 is a rear elevational view thereof.

The male ring member 11, as can be seen in FIG. 2, has an outer contour seen by the viewer which provides a rim 26 corresponding to the end 27 of a boss 28 molded as part of the ring 11 and as will be described in greater detail hereinafter.

As is also visible from FIG. 2 the attachment pieces 20 and 21 have shield-shaped members 30 and 31 which are similar in construction to the members 18 and 19, except that the shield members 30 and 31 each have the pins 16, 17 which project through holes 14 and 15 into holes in the members 18 and 19, respectively.

Figure 5:
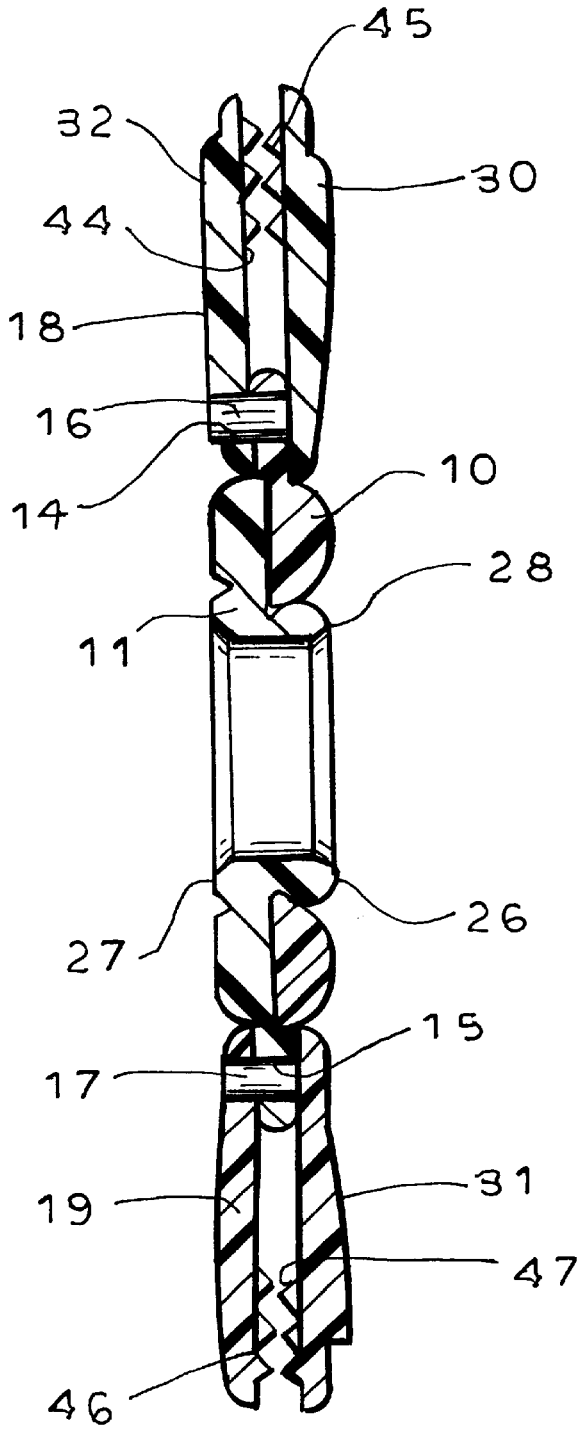
FIG. 5 is a cross sectional view taken along the line V—V of FIG. 1.
Figure 6:
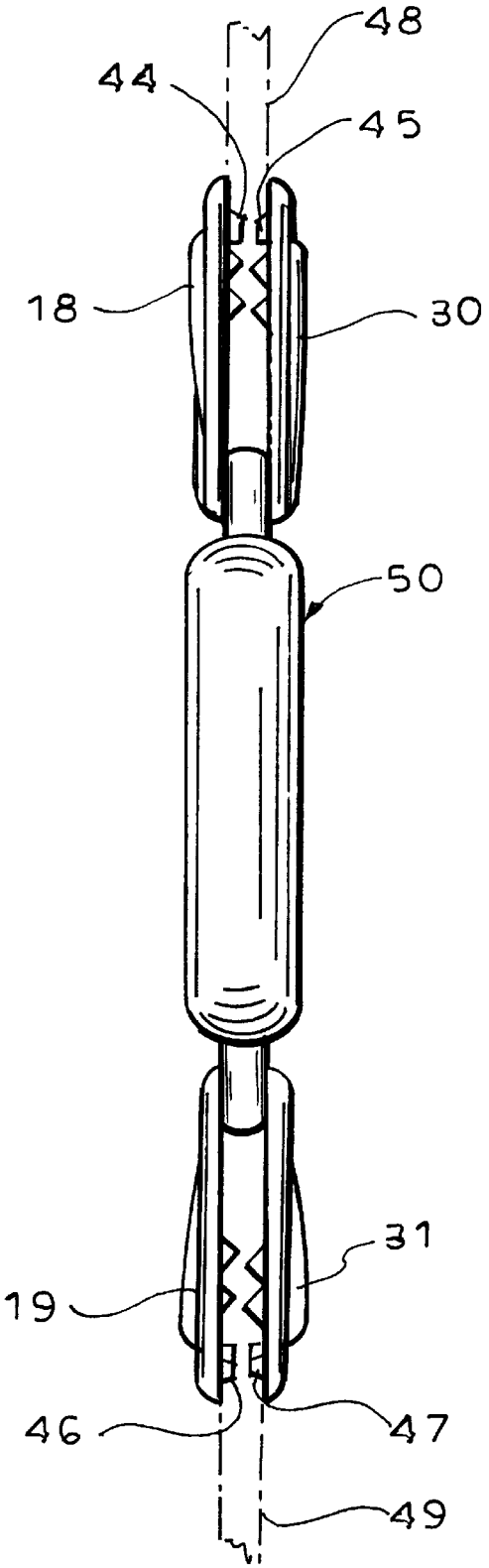
FIG. 6 is a side elevational view of the closure with the garment portion shown in dot-dash lines.
Figure 10:
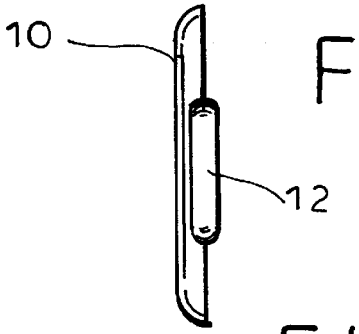
FIG. 10 is a top view of the female ring.
Figure 9:
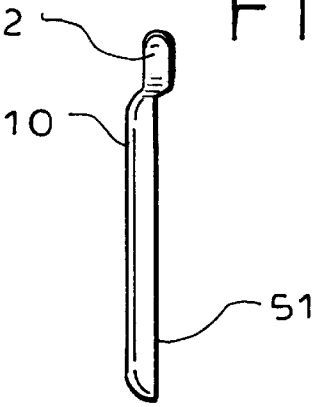
FIG. 9 is a right side elevational view of the female ring.

As will be apparent from FIGS. 5 and 6, in addition, members 18 and 30 have formations or teeth 44 and 45 while the members 19 and 31 have corresponding teeth 46 and 47 which bite into the fabric 48, 49 of the garment pieces to which the pushbutton closure is attached so that clamping of the shield members together and welding will lock the parts of the attachment pieces 20 and 21 together and onto the pieces of fabric. From FIGS. 7 through 11, the female ring 10 can be seen in greater detail.

The female member 10 (FIGS. 7–11) has a hole 52 dimensioned to accommodate the boss 26 and form a contour as has been described in connection with FIGS. 1 and 2 at 27. It is rounded and of convex curvature outwardly as can be seen from FIGS. 1, 2, 6 and 9 through 11. The boss can be pressed into the hole to form the press button therewith.

The boss 26 (FIGS. 12 through 16) is cylindrical and formed on the inside of the male member 11. The male member 11 has a planar annular surface 53 surrounding the boss 26 and the lug 13 lies in the plane of this surface. Similarly, surrounding the hole 52 is a planar surface 51 of the female member 10. The lug 12 lies in the plane of the surface 51.

On its exterior surface, the male member 11 is provided with the rim like formation 27 which mimics the end of the boss 26.

As will be apparent from FIGS. 7 to 16, when the boss 26 is snapped into the hole 52 the press button is engaged. When the members 10 and 11 are pulled apart, the closure is disengaged. The members 10 and 11 are composed of injection molded plastic which is softer than that of the attachment pieces 20 and 21.

These members can be pressed together to form the press button 50. The shield elements of the attachment pieces have been shown in greater detail in FIGS. 17 through 26. In FIGS. 17 through 21, a shield elements of the type shown at 30 and 31 has been illustrated. On its inner side, the shield element is provided with the tooth formation 45 together with a row of pins 16 as described. On its opposite side, only a kidney shaped land 55 (and traces of the pins 16) externally of the bulge 56 can be seen. Shield members 18, 19 can have a land 60 at which the holes 34 open to receive the pins 16, 17.

Figure 8:
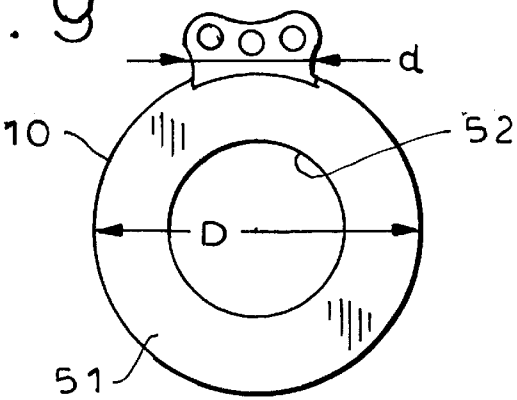
FIG. 8 is an elevational view from an opposite side of the female ring.
Figure 11:
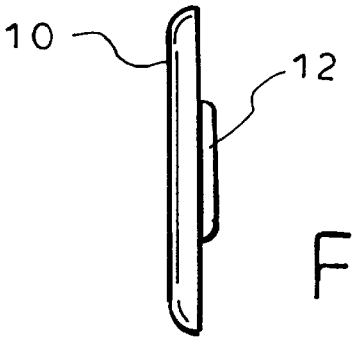
FIG. 11 is a bottom view of the female ring.
Figure 7:
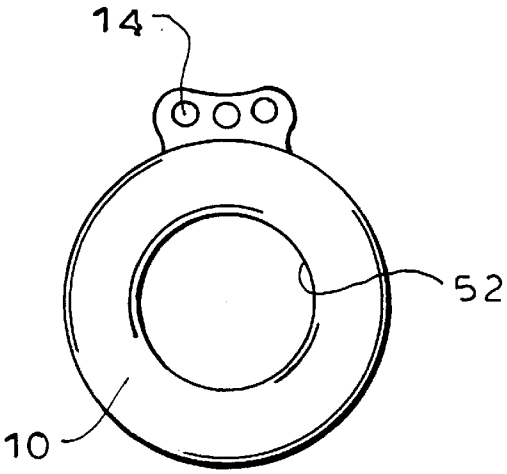
FIG. 7 is an elevational view from an opposite side of the female ring.
Figure 13:
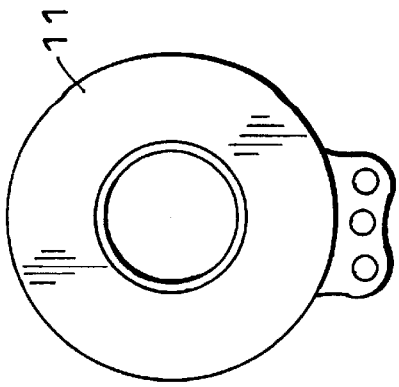
FIG. 13 is a view from the opposite side of the male ring.
Figure 15:
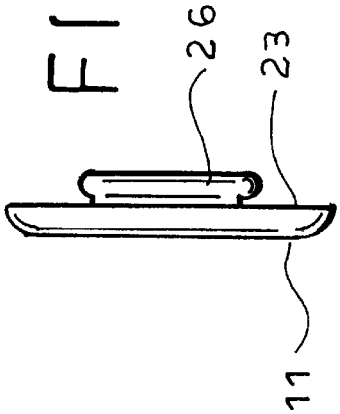
FIG. 15 is a top view of the male ring.
Figure 14:
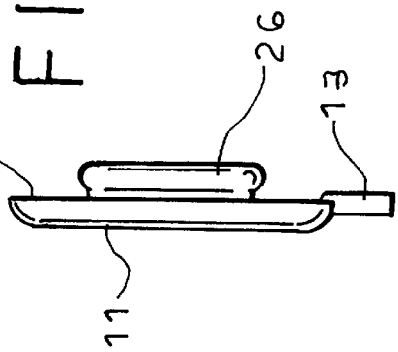
FIG. 14 is a right side elevational view of the male ring.
Figure 16:
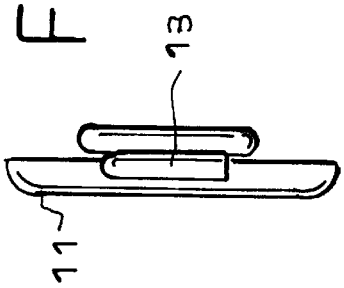
FIG. 16 is a bottom view of the male ring.
Figure 12:
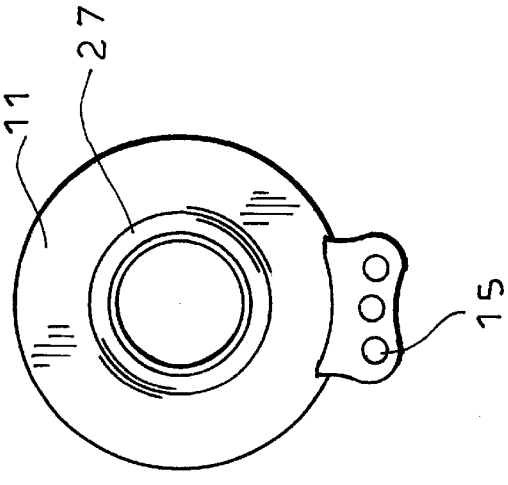
FIG. 12 is an elevational view from one side of the male ring showing a similar contour to the view of FIG. 7.
Figure 19:
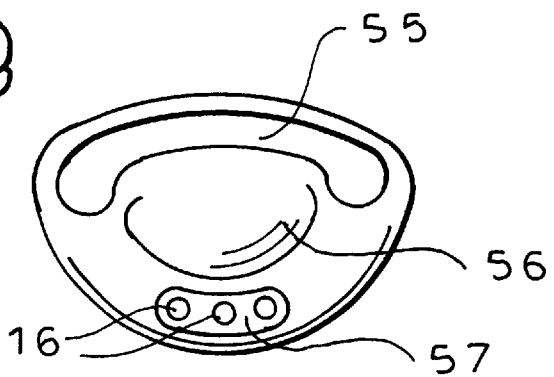
FIG. 19 is a right side elevational view of this shield element.
Figure 20:
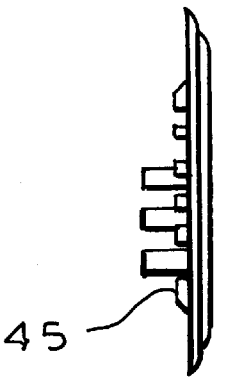
FIG. 20 is a top view of FIG. 17.
Figure 18:
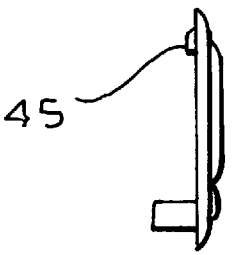
FIG. 18 is an elevational view of this shield element from the opposite side.
Figure 21:
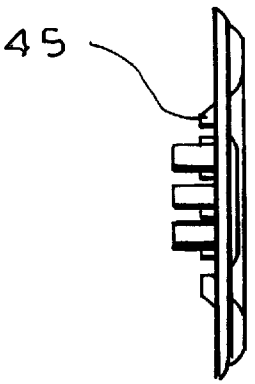
FIG. 21 is a bottom view.
Figure 17:
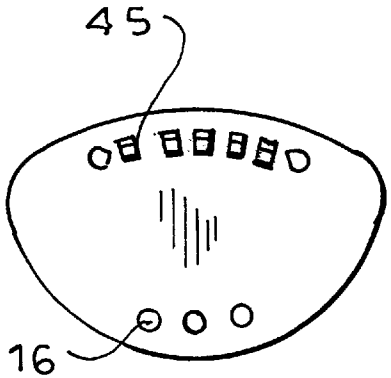
FIG. 17 is an elevational view from one side of the shield element provided with the posts.
Figure 23:
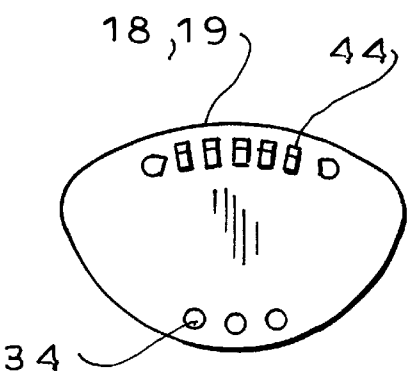
FIG. 23 is an elevational view of this shield element from the opposite side.
Figure 25:
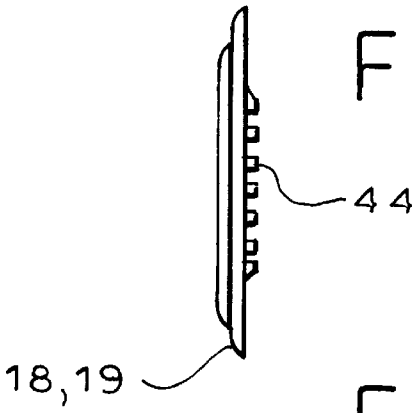
FIG. 25 is a top view thereof.
Figure 24:
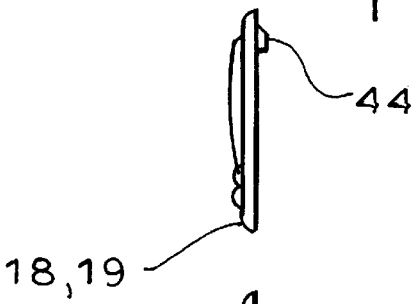
FIG. 24 is a right side elevational view of the element of FIGS. 22 and 23.
Figure 26:
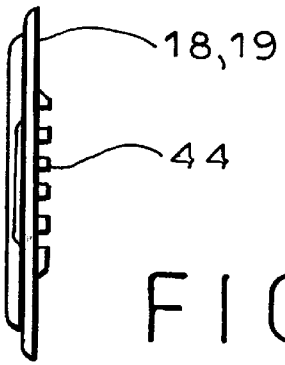
FIG. 26 is a bottom view of this shield element.
Figure 22:
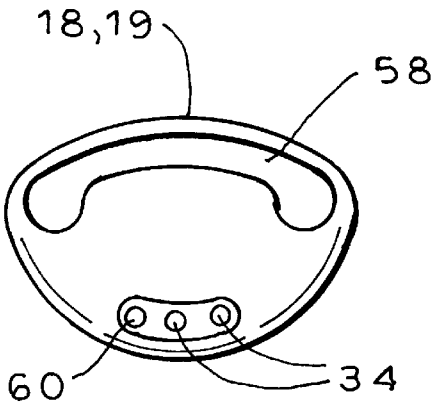
FIG. 22 is an elevational view from an outer side of the other shield element of each attachment piece.

It has been found that the lug attached to the rings requires a certain minimum width to prevent damage to the fastener by twisting. In practice, the lug, e.g. as shown in FIG. 8 should have a width d at its narrowest part which bears a relationship to the diameter D of the respective ring such that the ratio D/d ranges between 1.2 and 3 and is preferably between 1.7 and 2.5. In practical embodiments, D can be, say, 75 mm while d is say 30 mm corresponding to a ratio of 2.5 or D may be say 12 mm while d is 7 mm, corresponding to a ratio of 1.7.

Mention has already been made of the fact that with the invention it is not necessary to prepunch the fabric. The pins, e.g. 16 and 17 can pierce through the fabric wherever the attachment pieces are to be located and the danger that the attachment pieces will shift relative to the fabric because of prepunching can be avoided.

We claim:

1. A press-button garment closure comprising:

a female closure member in the form of a first ring having a hole and a first lug projecting laterally of the first ring;

a male closure member in the form of a second ring externally matching the first ring, a boss press-fittingly receivable in said hole, and a second lug projecting laterally of the second ring, said closure members being formed from relatively soft plastic; and respective attachment pieces of relatively hard plastic connected to said lugs and securing each of said members to a part of a garment.

2. The press-button garment closure defined in claim 1 wherein each of said attachment pieces comprises a pair of shield-shaped elements interconnected by posts, straddling the respective part of the garment and connected to a respective one of said lugs.

3. The press-button garment closure defined in claim 2 wherein each of said lugs has a formation mating with a complementary formation in one of said elements.

4. The press-button garment closure defined in claim 3 wherein said formations are pins and holes.

5. The press-button garment closure defined in claim 4 wherein each of said lugs has a plurality of holes and one of said elements has a plurality of pins and the other of said elements has a plurality of holes receiving the pins after the pins pass through the holes in said lug.

6. The press-button garment closure defined in claim 5 wherein the elements of a respective pair are welded together and to a strap received between the elements of the respective pair.

7. The press-button garment closure defined in claim 1 wherein said members are of one color and said attachment pieces are of another color.

8. The press-button garment closure defined in claim 1 wherein parts of a back band of a brassiere are secured to said attachment pieces.

9. The press-button garment closure defined in claim 1 wherein parts of a shoulder strap of a brassiere are secured to said attachment pieces.

10. The press-button garment closure defined in claim 1 wherein matching outer parts of said first and second rings have outwardly convex curved cross sections.

11. The press-button garment closure defined in claim 10 wherein said first ring has a planar inner surface abutting a planar surface of said second ring surrounding said boss.

12. The press-button garment closure defined in claim 11 wherein said boss is tubular.

13. The press-button garment closure defined in claim 12 wherein each of said lugs has three holes in a row and receiving a corresponding number of pins on one of said elements.

14. The press-button garment closure defined in claim 13 wherein said members are of one color and said attachment pieces are of another color.

15. A press-button garment closure comprising:

a female closure member in the form of a first ring having a hole and a first lug projecting laterally of the first ring;

a male closure member in the form of a second ring externally matching the first ring, a boss press-fittingly receivable in a hole and a second lug projecting laterally of the second ring; and respective attachment pieces connected to said lugs and securing each of said members to a respective part of a garment, the ring of at least one of said members having an outer diameter D and the respective lug having a width d such that the ratio D/d ranges between 1.2 and 3.

16. The press button garment closure defined in claim 1 wherein said ratio ranges between 1.7 and 2.5.

17. A press button garment closure comprising:

a first ring having a hole and affixed to a part of a garment, a second ring externally matching the first ring and formed with a lug projecting laterally of the second ring, and respective attachment pieces connected to said lug and securing said second ring to another part of said garment, one of said rings being provided with a boss press fittingly receivable in a hole of the other ring, said second ring having an outer diameter D and said lug having a width d such that the ratio D/d ranges between 1.2 and 3.

18. A press button garment closure defined in claim 17 wherein said ratio is between 1.7 and 2.5.

19. A press button garment closure defined in claim 17 wherein said rings are comprised of relatively soft plastic and said attachment pieces are composed of relatively hard plastic.

20. A press button garment closure defined in claim 17 wherein one of said attachment pieces is provided with pins piercing through the respective garment and welded to the other attachment piece, said pins also extending through said lug.

* * * * *